US006244906B1

(12) United States Patent
Hashim et al.

(10) Patent No.: US 6,244,906 B1
(45) Date of Patent: Jun. 12, 2001

(54) LOW CROSS TALK PLUG AND JACK

(75) Inventors: Amid Ihsan Hashim, Randolph, NJ (US); Jaime Ray Arnett, Fishers, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/468,456

(22) Filed: Dec. 21, 1999

(51) Int. Cl.[7] ..... H01R 24/00
(52) U.S. Cl. ..... 439/676; 439/941
(58) Field of Search ..... 439/676, 638, 439/607–610, 395, 441

(56) References Cited

U.S. PATENT DOCUMENTS

| | | | |
|---|---|---|---|
| 4,438,300 | 3/1984 | Morse | 379/447 |
| 5,011,435 | 4/1991 | Seong et al. | 439/676 |
| 5,041,018 | 8/1991 | Arnett | 439/536 |
| 5,096,439 | 3/1992 | Arnett | 439/536 |
| 5,096,442 | 3/1992 | Arnett et al. | 439/676 |
| 5,186,647 | 2/1993 | Denkmann et al. | 439/395 |
| 5,299,956 | 4/1994 | Brownell et al. | 439/638 |
| 5,399,107 | 3/1995 | Gentry et al. | 439/676 |
| 5,547,405 | 8/1996 | Pinney et al. | 439/894 |
| 5,562,479 | 10/1996 | Pallas et al. | 439/404 |
| 5,580,270 | 12/1996 | Pantland et al. | 439/395 |
| 5,599,209 | 2/1997 | Belopolsky | 439/676 |
| 5,716,237 | 2/1998 | Conorich et al. | 439/660 |
| 5,893,771 | 3/1999 | Kern, Jr. et al. | 439/344 |
| 5,897,395 | 4/1999 | Arnett | 439/536 |
| 5,899,770 | 5/1999 | Ezawa | 439/418 |
| 5,915,989 | 6/1999 | Adriaenssens et al. | 439/404 |
| 5,924,896 | 7/1999 | Arnett et al. | 439/676 |
| 5,997,358 | 12/1999 | Adriaenssens et al. | 439/676 |
| B1 5,299,956 | 10/1995 | Brownell et al. | 439/638 |

*Primary Examiner*—Paula Bradley
*Assistant Examiner*—James Harvey
(74) *Attorney, Agent, or Firm*—Duane, Morris & Heckscher LLP

(57) ABSTRACT

A modular plug is provided having a dielectric housing including a first end and a second end. The first end defines an electrical connector section having signal conductors arranged to mate with a modular jack. At least two substantially planar blades are positioned adjacent to one another in the first end such that a dielectric wall is positioned between the blades with an edge portion of each of the blades being electrically and mechanically accessible, wherein each of the blades is aligned with one of the signal conductors. A modular jack is provided that includes an insulating body having an interior cavity communicating with a modular plug receiving opening formed in a front end of the body for receiving a complementary modular plug. A plurality of openings in the body communicate with the cavity and are sized and shaped to each receive a jack contact. A plurality of jack contacts are mounted within the cavity. Each jack contact has an engagement portion exposed within the cavity wherein each engagement portion of each of the jack contacts comprises an upper interface region and a lower interface region that are laterally offset relative to one another such that the lower interface region is spaced away from the modular plug receiving opening.

18 Claims, 5 Drawing Sheets

LOW CROSS TALK PLUG AND JACK

FIELD OF THE INVENTION

The present invention relates generally to electrical connectors and, more particularly, to a modular plug and jack of the type used in telecommunications equipment.

BACKGROUND OF THE INVENTION

Modular plug and jack connectors provide easy connect/disconnect capability between electrical circuits within telecommunications equipment. Such modular plugs and jacks are particularly popular in association with telephone sets, where they were first used, and more recently in association with a large variety of peripheral devices that are connected to telephone lines, e.g., modems, facsimile machines, personal computers, etc. However, conventional modular plug and jack connectors were not necessarily designed to handle the high speed data rates that are common place with many peripheral devices. As a result, problems have arisen as a result of the use of conventional modular plug and jack connector systems in non-conventional applications.

For example, it is well known in the art that cross-talk occurs when signals conducted over a first signal path, e.g., a pair of terminal contact wires associated with a communications connector, are partly transferred by inductive or capacitive coupling into a second signal path, e.g., another pair of terminal contact wires in the same connector. The transferred signals are defined as "cross-talk" in the second signal path, and such cross-talk degrades any signals that are routed over the second path. As data transmission speeds have increased, the deleterious effects of cross-talk on data transmissions has also increased. Numerous prior art connectors have been proposed for reducing the effects of such "cross-talk" by, e.g., adding compensating "cross-talk" to the overall circuit, i.e., adding capacitances to nullify or compensate for the inherent cross-talk in the system.

It is also the case that modular plug and jack connectors experience cross-talk and require compensating devices or circuits. Often, such modular plug and jack connectors are designed to compensate for plugs or jacks having a prescribed amount of cross-talk. This can be disadvantageous since the very circuitry that has been added for compensating for cross-talk in a particular plug or jack may in fact diminish signal integrity when mated to another plug or jack having less than the prescribed amount of cross-talk. As a result, there is a need for a low cross-talk plug and jack connector system which allows for "backward" compatibility with existing plug and jack systems.

SUMMARY OF THE INVENTION

The present invention provides a modular plug having a dielectric housing including a first end and a second end. The first end defines an electrical connector section having signal conductors arranged to mate with a modular jack. At least two substantially planar blades are positioned adjacent to one another in the first end such that a dielectric wall is positioned between the blades with an edge portion of each of the blades being electrically and mechanically accessible, wherein each of the blades is aligned with one of the signal conductors.

A modular jack is provided that includes an insulating body having an interior cavity communicating with a modular plug receiving opening formed in a front end of the body for receiving a complementary modular plug. A plurality of openings in the body communicate with the cavity and are sized and shaped to each receive a jack contact. A plurality of jack contacts are mounted within the cavity. Each jack contact has an engagement portion exposed within the cavity wherein each engagement portion of each of the jack contacts comprises an upper interface region and a lower interface region that are offset relative to one another such that the lower interface region is spaced away from the modular plug receiving opening.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

The following description of the preferred embodiments of the invention are intended to be read in connection with the foregoing drawings and are to be considered a portion of the entire written description of this invention. As used in the following description, terms such as, "horizonal", "vertical", "up", and "down", as well as adjectival and adverbial derivatives thereof (e.g., "horizontally", "upwardly", etc.) simply refer to the orientation of the structure of the invention as it is illustrated in the particular drawing figure when that figure faces the reader. Similarly, the terms "inwardly" and "outwardly" generally refer to the orientation of a surface relative to its axis of elongation, or axis of rotation, as appropriate. Also, the terms "connected" and "interconnected," when used in this disclosure to describe the relationship between two or more structures, mean that such structures are secured or attached to each other either directly or indirectly through intervening structures, and include pivotal connections. The term "operatively connected" means that the foregoing direct or indirect connection between the structures allows such structures to operate as intended by virtue of such connection.

Figure 1:
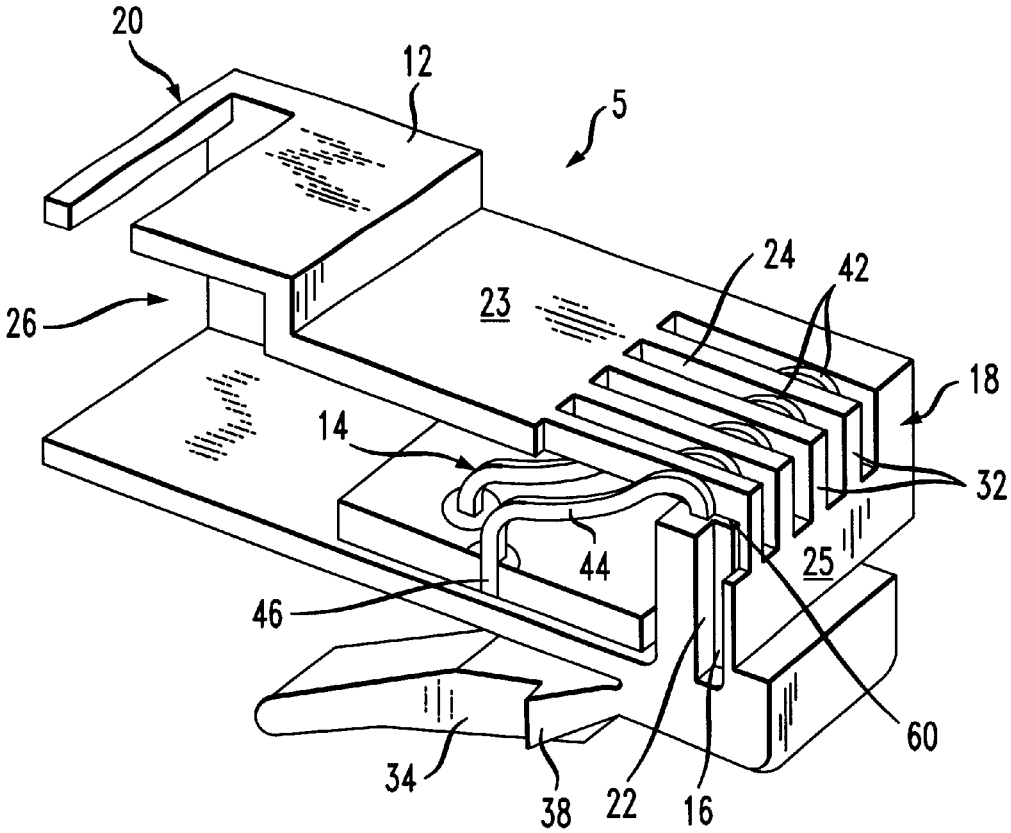
FIG. 1 is a perspective, broken-away view of a low cross-talk modular plug formed in accordance with the present invention.
Figure 2:
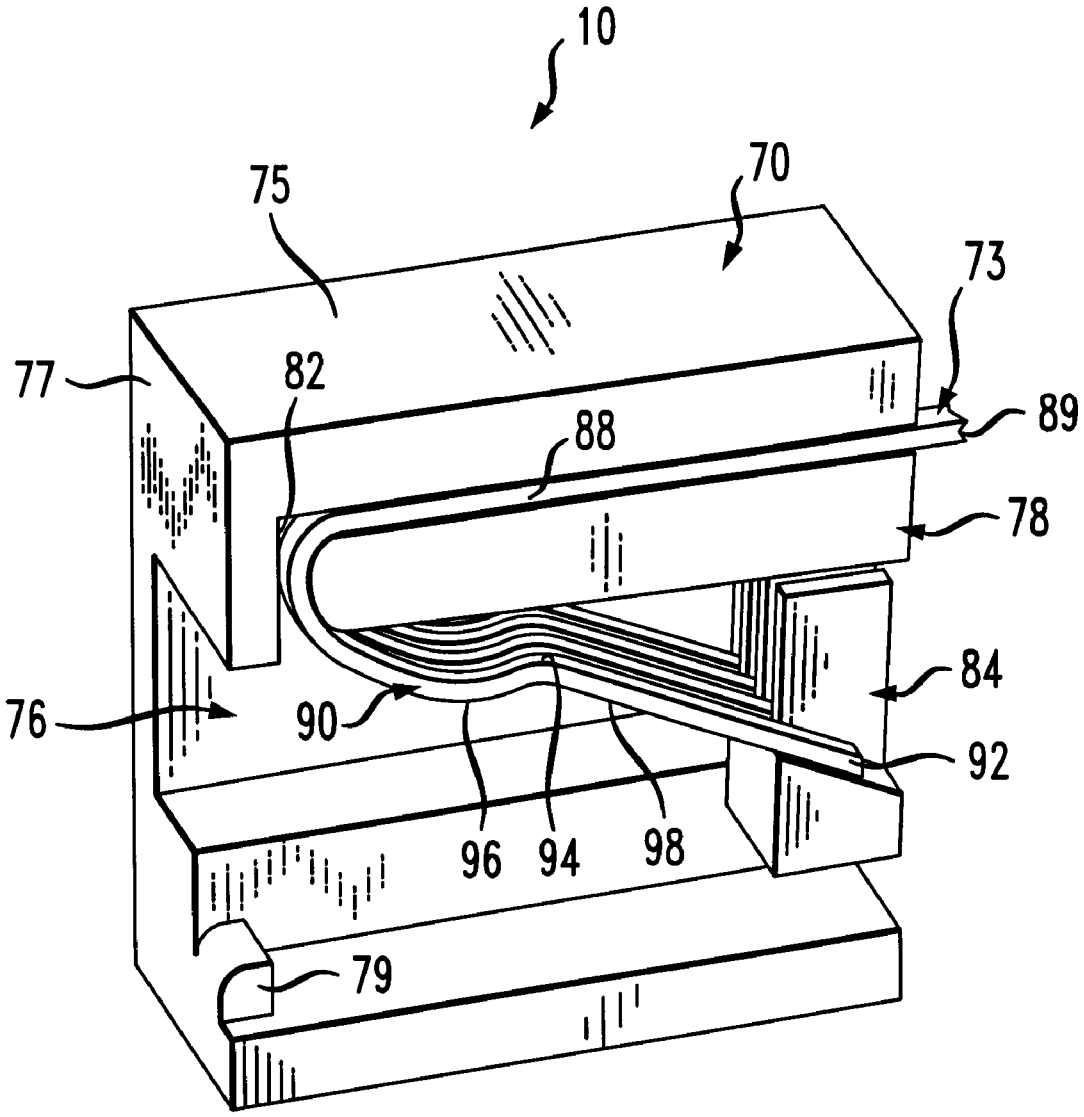
FIG. 2 is a perspective broken-away view of a low cross-talk modular jack formed in accordance with the present invention.

FIGS. 1 and 2 show a modular plug 5 and a modular jack 10 formed in accordance with the present invention. More particularly, modular plug 5 includes a dielectric housing 12, a plurality of terminal contacts 14, and a plurality of blade contacts 16. Housing 12 is generally rectilinearly shaped, has a first end 18, a second end 20, and defines within its structure a plurality of individually delimited void spaces, which are often referred to in the art as contact or terminal "cavities". Housing 12 may be formed from a suitable polymer material, such as polycarbonate, or the like. First end 18 includes a plurality of blind blade cavities 22 and a plurality of open terminal contact cavities 24. Plurality of blind blade cavities 22 are positioned in spaced parallel relation to one another, between end surface 25 of housing 12 and plurality of terminal contact cavities 24. One blade cavity 22 is arranged in aligned spaced relation to each terminal contact cavity 24 so as to be substantially coplanar with it. Advantageously, blind blade cavities 22 are formed in open communication with upper surface 23 and an upper portion of end surface 25 of housing 12, but are electrically insulated and physically isolated from terminal contact cavities 24. First end 18 of housing 12 also includes walls 32 which aid in defining and electrically separating laterally adjacent pairs of blind blade cavities 22 and terminal contact cavities 24.

Terminal contact cavities 24 are positioned in spaced substantially parallel relation to one another, and communicate with upper surface 23 and a cable opening 26 defined within second end 20 of housing 12. Walls 32 separate and isolate adjacent ones of terminal cavities 24. Each terminal contact cavity 24 is sized and shaped so as to accept, guide, and separate adjacent terminal contacts 14.

Housing 12 also includes a depressible, cantilevered tab 34 that projects outwardly at a relatively acute angle from a bottom surface for locking modular plug 5 within a modular jack 10. Tab 34 is formed with two laterally spaced shoulders 38. When modular plug 5 is mated with modular jack 10, shoulders 38 engage corresponding recesses in modular jack 10 so as to lock modular plug 5 in place. When modular plug 5 is to be removed from modular jack 10, tab 34 is merely depressed thereby disengaging shoulders 38 from their respective mating recesses so that modular plug 5 may be axially withdrawn from modular jack 10.

Plurality of terminal contacts 14 each comprise a cantilevered beam formed of conductive spring quality material, such as brass, phosphor bronze, beryllium copper, or the like. Each terminal contact 14 includes a radiused mating end 42, a beam 44, and a cable or printed wiring board termination 46. More particularly, each radiused mating end 42 of each terminal contact 14 provides an electrical and mechanical interface for engagement with a corresponding contact in modular jack 10, and is positioned at or just below upper surface 23 and between walls 32 of housing 12 when terminal contacts 14 are mounted in terminal cavities 24. Radiused mating end 42 often has an electrodeposited layer of highly conductive material, such as gold, or the like, on its exposed contact surface to improve both the electrical and mechanical characteristics of the interconnection between modular plug 5 and modular jack 10. Beam 44 provides for the elastic storage of energy when radiused mating end 42 is deflected during the mating engagement of modular plug 5 and modular jack 10, and is fixed at one end to the interior of housing 12 by cable or printed wiring board termination 46.

Cable or printed wiring board termination 46 is formed on terminal contact 14 in spaced relation to radiused mating end 42, and may include an insulation piercing or displacing contact for terminating wires or cable positioned within cable opening 26 of second end 20. Alternatively, termination 46 may include an eye-of-the-needle type contact, solder pin, surface mount, or like printed wiring board interconnection device of the type well known in the art, when modular plug 5 is used in connection with a printed wiring board. Termination 46 of terminal contact 14 may be arranged "in-line" or "staggered" to facilitate high density versions of modular plug 5.

It will be understood that terminal contacts 14 are arranged in terminal cavities 24 in substantially parallel relation to one another, and provide relatively small and adjustable levels of self-capacitance to modular plug 5 due the narrow width of metal (i.e., the width of radiused mating end 42, beam 44, and termination 46), that is separated by the dielectric material forming walls 32.

Each blade contact 16 is sized and shaped so as to be fixedly received within a corresponding blind blade cavity 22, and may be formed as an elongated rod, flat plate or disk of conductive material, such as brass, phosphor bronze, beryllium copper, or the like. Blade contacts 16 each include a jack conductor interface edge 60 that is exposed above an upper portion of end surface 25 of housing 12 when blade contact 16 is mounted within blind blade cavity 22. Walls 32, which extend between upper surface 23 and end surface 25, help to separate and isolate adjacent ones of blade contacts 16. Jack conductor interface edge 60 may be electroplated with a highly conductive material, such as gold, or the like.

It will be understood that blade contacts 16 are arranged in blind blade cavities 22 in substantially parallel relation to one another, so as to provide a known and adjustable level of self-capacitance to modular plug 5 due the adjustable area of metal that is separated by the dielectric material forming walls 32. Thus, blade contacts having a larger or smaller surface area or formed from varying thicknesses of metal may be inserted into blind blade cavities 22 so as to adjust the degree of self-capacitance in a particular modular plug 5. Additionally, the spacing between blind blade cavities 22 may be varied to adjust the self-capacitance. Preferably, at least two substantially planar blades are positioned adjacent to one another, so as to be in mutually parallel relation to one another, and aligned with a vertically oriented longitudinal plane (not shown) running through housing 12. In this way, dielectric walls 32 are positioned between blade contacts 16, with jack conductor interface edge 60 being electrically and mechanically accessible.

Referring to FIG. 2, modular jack 10 is a rectilinearly shaped receptacle that is adapted to receive a modular plug 5. Modular jack 10 is formed by an insulating housing 70 defining within its structure a void space or cavity that is sized to receive a modular plug. A plurality of jack contacts 73 are mounted within the cavity so as to be positioned for electrical and mechanical engagement with the terminal contacts of a mating modular plug. More particularly, insulating housing 70 is molded of a suitable material, such as polyester, and includes top, bottom and side walls 75, an opening 76 formed in a front end wall 77 and a rear wall 78. Opening 76 is sized and shaped for receiving modular plug 5, and the inner surfaces of the walls that define opening 76 often include internally defined recesses or shoulders 79 adapted for accepting shoulders 38 of modular plug 5. Insulating housing 70 includes a plurality of contact channels 82 that communicate with the interior void space formed between walls 75, and a plurality of contact slots 84. Jack contacts 73 are inserted into contact channels 82 and individually guided through the interior of housing 70 toward contact slots 84, with a plug contact interface portion of each jack contact 73 exposed adjacent to opening 76.

Jack contacts 73 are stamped and formed from a conductive material having suitable spring properties, such as brass, phosphor bronze, beryllium copper, or the like. Each contact has a clamped portion 88, an engagement spring portion 90, and a tail portion 92. Clamped portion 88 of each terminal contact 14 is positioned in narrow contact channels 82 which extend rearwardly within top wall 75 of insulating housing 70. Jack contacts 73 are retained in contact channels 82. Alternatively, jack contacts 73 may be "molded-in" as a part of the operation in which insulating housing 70 is injection molded, as is well known. A terminal end 89 of clamped portion 88 may be adapted for insertion into a plated-through-hole in a printed wiring board (not shown) or include a wire termination feature. Each engagement spring portion 90 extends through an opening at the end of its respective narrow contact slot 82 and is reversely bent so that engagement spring portion 90 extends diagonally into housing 70, from the upper portion of opening 76, and toward the rearward end of insulating housing 70 so as to be cantilevered within insulating housing 70.

Engagement spring portion 90 may be provided with a narrow band of electrodeposited conductive plating material, such as gold or the like, along its length. A central portion 94 of engagement spring portion 90 is radiused inwardly so as to form an inward "jog" or bend in the spring. In this way, engagement spring portion 90 may be viewed as having an upper interface region 96 and a lower interface region 98 that are offset relative to one another.

Tail portion 92 extends rearwardly in insulating housing 70 so as to be arranged at an angle relative to the direction of insertion of modular plug 5. This configuration of modular jack 10 is designed so that tail portions 92 can be inserted through slot 84 in rear wall 78 of housing 70. In this way, jack contacts 73 may be preloaded, via engagement with header 71 (FIG. 2). When used with a printed wiring board, insulating housing 70 is often provided with integrally molded posts for mounting the jack into appropriately sized and positioned holes in a printed wiring board, as is well known in the art.

For current category 5 modular jacks to operate at their specified cross-talk levels, they often require a prescribed amount of cross-talk to exist in the plug. Attempts to reduce the cross-talk in the plug often result in an overcompensated plug/jack mated combination, with unacceptable cross-talk levels. Efforts to improve cross-talk beyond category 5 had been hampered by the amount of cross-talk that must exist in the plug in order to maintain "backward" compatibility with existing category 5 modular jacks already installed in the field.

Figure 4:
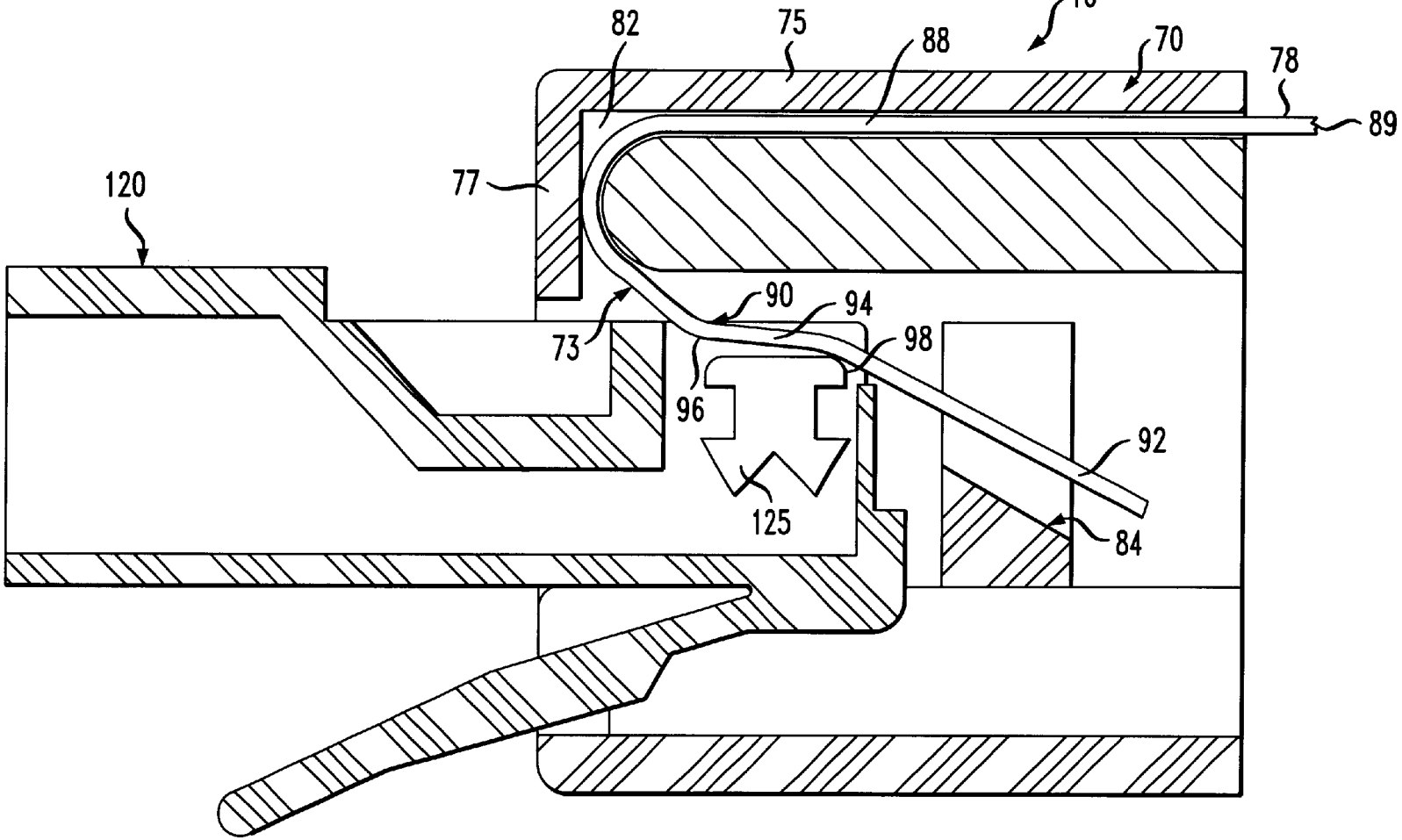
FIG. 4 is a cross-sectional view of a conventional modular plug installed in a modular jack formed in accordance with the present invention.
Figure 5:
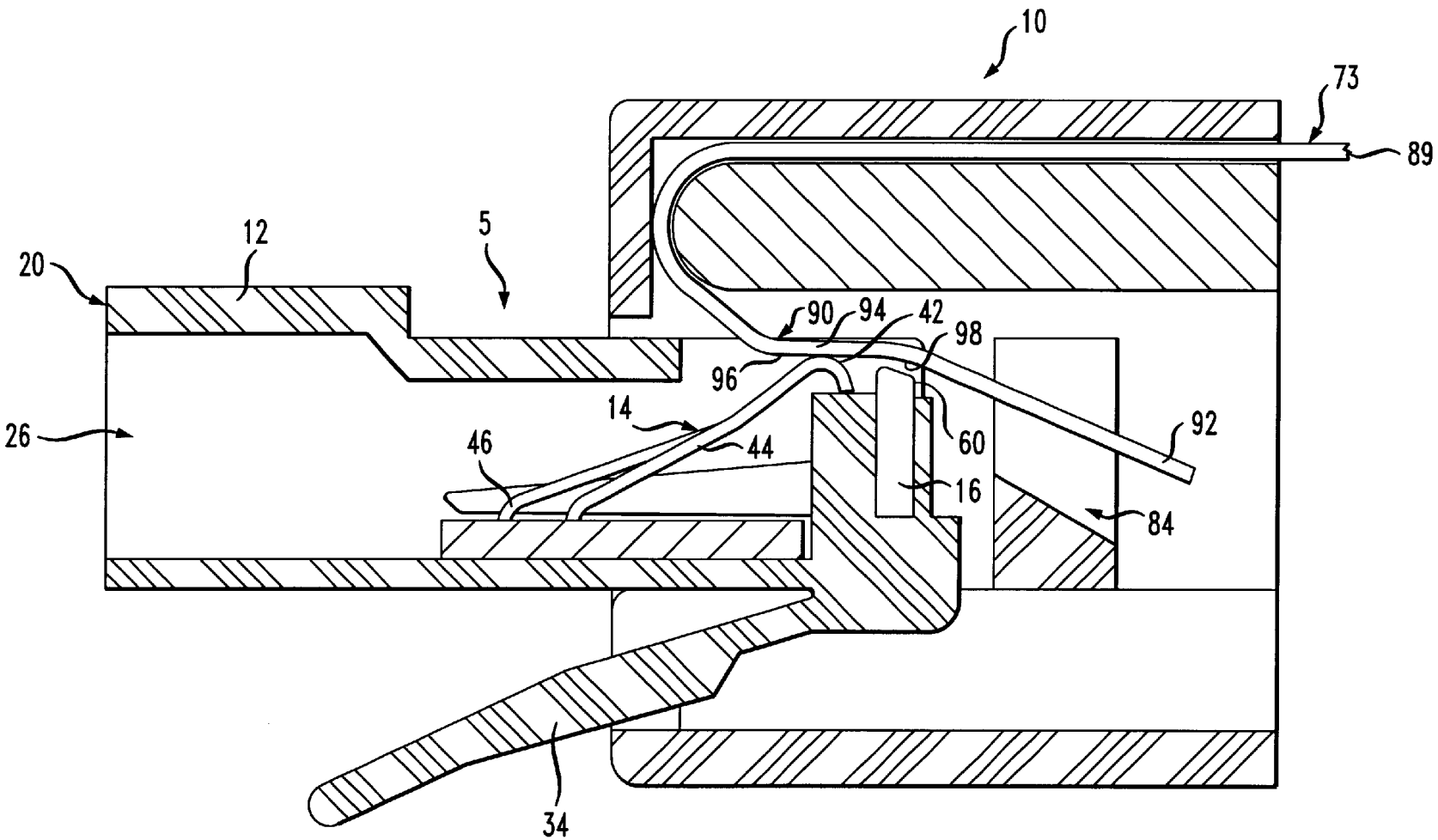
FIG. 5 is a cross-sectional view of a modular plug installed in a modular jack both formed in accordance with the present invention.

Modular plug 5 of the present invention is adapted to operate with the required amount of cross-talk when inserted into an existing category 5 jack (FIG. 3) but will also provide much reduced cross-talk when mated with modular jack 10 of the present invention (FIG. 5). Thus, the present invention provides for a modular plug and jack combination that, when mated with prior art modular plugs and/or jacks (FIGS. 3 and 4) will operate at category 5 specifications, but, when mated together (FIG. 5) provide operation with much reduced levels of cross-talk.

Figure 3:
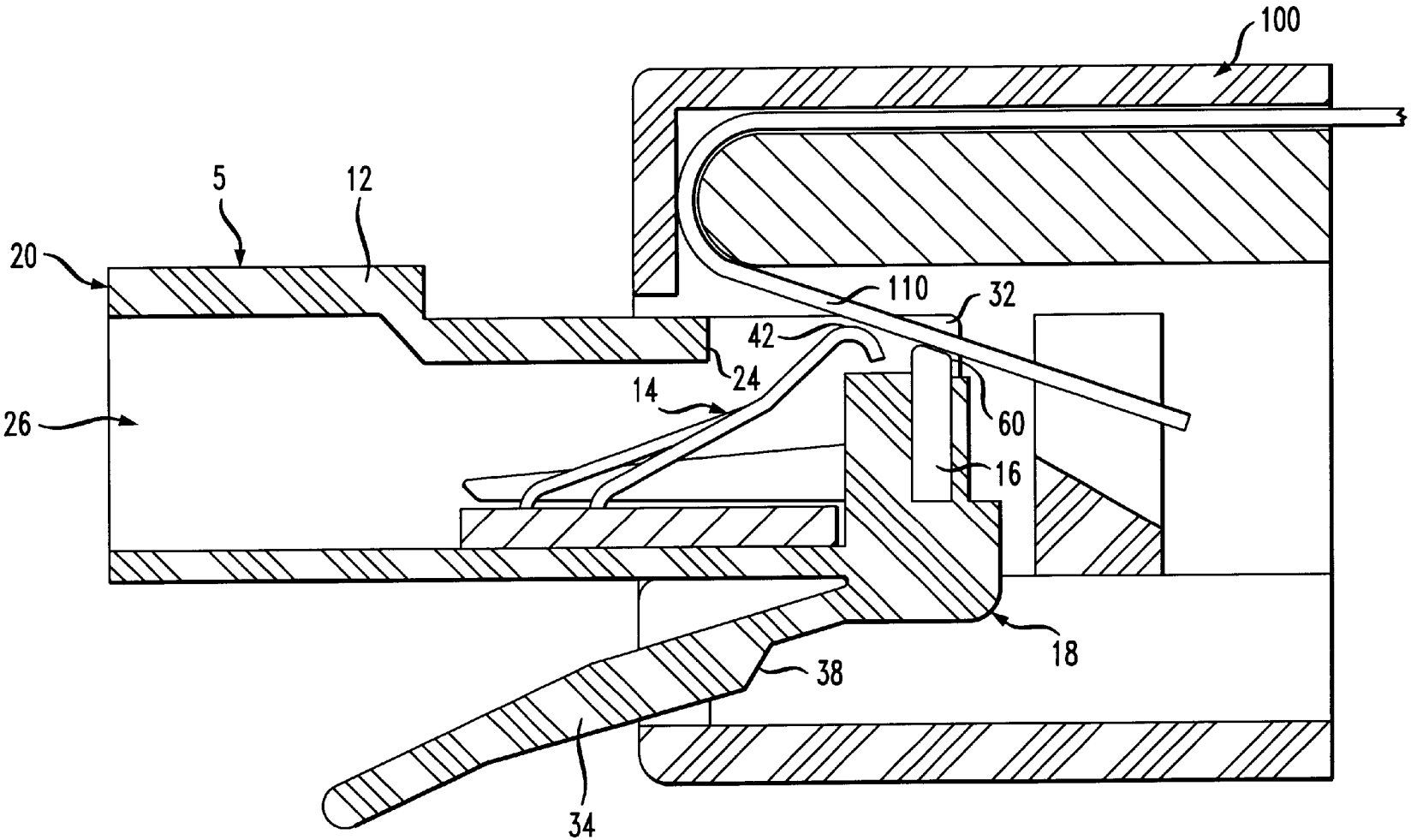
FIG. 3 is a cross-sectional view of a conventional modular jack having a modular plug formed in accordance with the present invention installed

Referring to FIG. 3, when a modular plug 5 formed in accordance with the present invention is mated with a prior art modular jack 100, i.e., a modular jack having a linear contact spring 110 positioned within the jack for engagement with a corresponding plug contact, modular plug 5 of the present invention provides the expected level of cross-talk for prior art category 5 plugs. More particularly, as modular plug 5 is inserted into prior art jack 100, jack spring contacts 110 engage jack conductor interface edge 60 of blade contacts 16. As this occurs, jack conductor 110 is deflected inwardly, away from modular plug 5. As modular plug 5 is further inserted into prior art modular jack 100, jack conductors 110 electrically and mechanically engage radius mating ends 42 of terminal contacts 14 thereby deflecting terminal contacts 14. Modular plug 5 continues its inward progress until shoulders 38 of tab 34 engage corresponding recesses in prior art modular jack 100 so as to lock modular plug 5 in place.

As shown in FIG. 3, when mated with a modular plug 5, each jack conductor 110 of a conventional modular jack 100 is in electrical and mechanical engagement with a terminal contact 14 and a blade contact 16. Since blade contacts 16 are electrically engaged with both terminal contacts 16 and jack conductor 110, they increase the capacitive cross-talk of the connection such that modular plug 5 provides a level of cross-talk which is normally compensated for in prior art jack installations. In this way, backward compatibility is maintained.

Referring to FIG. 4, when a prior art modular plug 120 is inserted into modular jack 10 of the present invention, the foregoing process is repeated with terminal contacts 125 of prior art plug 120 engaging lower interface region 98 of each jack contact 73 such that the combination of prior art plug 5 and modular jack 10 provides substantially the same level of cross-talk as is currently associated with prior art category 5 jack and plug systems.

Referring to FIGS. 1, 3, and 5, when a modular plug 5 and modular jack 10 of the present invention are mated, central portion 94 of each jack contact 73 positions lower interface region 98 in spaced relation to jack conductor interface edge 60 of each blade contact 16 when upper contact region 96 engages radiused mating end 42 of each terminal contact 14. Signicantly, the free end of radiused meeting end 42 engages a portion a dielectic housing 12 (shown generally at reference numeral 95) which stops the downward progress of terminal contact between 14 and thereby prevents mechanical or electrical engagement a blade contact 16 and jack contact 73. In this way, the lower capacitive cross-talk characteristics associated with terminal contacts 14 in modular plug 5 may be utilized, while the higher capacitive cross-talk characteristics associated with blades 16 are avoided.

It is to be understood that the present invention is by no means limited only to the particular constructions herein disclosed and shown in the drawings, but also comprises any modifications or equivalents within the scope of the claims.

What is claimed is:

1. A modular telecommunication plug comprising:

a dielectric housing having a first end and a second end, said first end defining an electrical connector section having signal conductors terminated to signal contacts that are arranged to mate with a modular jack, and including at least two substantially planar blades positioned adjacent to one another in said first end such that a first dielectric wall is positioned between each pair of said blades with an edge portion of each of said blades being electrically and mechanically accessible, and a second dielectric wall is positioned between said blades and said signal conductors wherein each of said blades is aligned with and spaced from a respective one of said signal contacts.

2. A modular plug according to claim 1 wherein each of said blades is arranged in an aligned array with confronting areas of said adjacent blades separated by said first dielectric wall so as to create capacitive coupling between said adjacent blades.

3. A modular plug according to claim 2 wherein said first end includes a plurality of blind cavities and a plurality of open contact cavities wherein said plurality of blind cavities are positioned in spaced parallel relation to one another with one blind cavity being arranged in aligned spaced relation to each open contact cavity and further wherein each of said blades is sized and shaped so as to be fixedly received within one of said blind cavities.

4. A modular plug according to claim 3 wherein said blades are formed as a flat plate or disk of electrically conductive material.

5. A modular plug according to claim 4 wherein said blades each include a jack conductor interface edge that is exposed at an upper portion said housing.

6. A modular plug according to claim 2 wherein said blades are arranged in said blind cavities in substantially parallel relation to one another, so as to provide a selectively predetermined level of self-capacitance.

7. A modular plug according to claim 1 comprising at least two substantially planar blades positioned adjacent to one another, so as to be aligned with one another such that said first dielectric wall is positioned between said at least two blades.

8. A modular plug according to claim 1 wherein said first end includes a plurality of blind cavities and a plurality of open contact cavities wherein said plurality of blind cavities are positioned in spaced parallel relation to one another with one blind cavity being arranged in aligned spaced relation to each open contact cavity.

9. A modular plug according to claim 8 wherein said blind cavities are electrically insulated and physically isolated from said open contact cavities.

10. A modular plug according to claim 8 wherein said first end includes walls which define and electrically separate laterally adjacent pairs of blind cavities and open terminal cavities.

11. A modular plug according to claim 10 wherein said open contact cavities are positioned in spaced substantially parallel relation to one another and said first and second dielectric walls separate and isolate adjacent ones of said open contact cavities.

12. A modular plug according to claim 1 wherein said signal conductors comprise a plurality of cantilevered beams having a radiused mating end and a termination end wherein each radiused mating end provides an electrical and mechanical interface for engagement with a corresponding contact in said modular jack, and is positioned in open contact cavities in substantially parallel relation to one another so as to provide a relatively small and adjustable level of self-capacitance.

13. A modular plug according to claim 12 wherein said termination end is formed on said terminal contact in spaced relation to said radiused mating end and includes an insulation piercing wire termination.

14. A modular plug according to claim 12 wherein said termination end is formed on said terminal contact in spaced relation to said radiused mating end and includes an insulation displacing wire termination.

15. A modular plug according to claim 12 wherein said termination end is formed on said terminal contact in spaced relation to radiused mating end and includes a printed wiring board interconnection device.

16. A modular telecommunication jack, comprising:

an insulating housing having an interior cavity communicating with a modular plug receiving opening formed in a front end of said housing for receiving a complementary modular plug having signal conductors arranged therein;

a plurality of openings in said housing communicating with said cavity and sized and shaped to each receive a jack contact; and a plurality of said jack contacts positioned within said cavity each having a engagement portion exposed within said cavity wherein each engagement portion of each of said jack contacts comprises an upper plug signal conductor interface region and a lower plug signal conductor interface region that are interconnected by a bend so as to be offset relative to one another.

17. A modular jack according to claim 16 wherein said plug signal conductor upper interface region is radiused inwardly so that said lower plug signal conductor interface region is spaced away from a blade positioned at a front end of a modular plug when said modular plug is in mating engagement with said modular jack.

18. An interconnection system capable of backward compatibility comprising:

a modular telecommunication plug comprising:

a dielectric housing having a first end and a second end, said first end defining an electrical connector section having signal conductors terminated to signal contacts that are arranged therein to mate with a modular jack, and including at least two substantially planar blades positioned adjacent to one another in said first end such that a first dielectric wall is positioned between each of said blades with an edge portion of each of said blades being electrically and mechanically accessible, and a second dielectric wall is positioned between said blades and said signal conductors wherein each of said blades is aligned with and spaced from one of said signal contacts; and a modular jack, comprising:

an insulating body having an interior cavity communicating with a modular plug receiving opening formed in a front end of said body for receiving a complementary modular plug having signal conductors arranged therein;

a plurality of openings in said body communicating with said cavity that are sized and shaped to each receive a jack contact; and a plurality of said jack contacts mounted within said cavity each having a engagement portion exposed within said cavity wherein each engagement portion of each of said jack contacts comprises an upper plug signal conductor interface region and a lower plug signal conductor interface region that are interconnected by a bend so as to be offset relative to one another such that said lower plug signal conductor interface region is spaced away from said blades when said modular plug is in mating engagement with said modular jack.

* * * * *